US008977160B2

(12) United States Patent
Buchanan et al.

(10) Patent No.: US 8,977,160 B2
(45) Date of Patent: Mar. 10, 2015

(54) OVERMOLDED SHUTTER FOR USE IN TONER CONTAINING SUPPLY ITEMS OF AN IMAGING APPARATUS

(75) Inventors: John Andrew Buchanan, Paris, KY (US); James Anthany Carter, II, Lexington, KY (US); Benjamin Keith Newman, Lexington, KY (US); Matthew Lee Rogers, Lexington, KY (US); Christopher Gene Vowels, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 465 days.

(21) Appl. No.: 13/340,944

(22) Filed: Dec. 30, 2011

(65) Prior Publication Data

US 2013/0170871 A1 Jul. 4, 2013

(51) Int. Cl.
*G03G 15/08* (2006.01)

(52) U.S. Cl.
CPC ..... *G03G 15/0886* (2013.01)
USPC ..... 399/106; 399/105; 399/262

(58) Field of Classification Search
CPC ..... G03G 15/0832; G03G 2215/0692; G03G 15/0837; G03G 15/0867; G03G 15/0872; G03G 15/0886
USPC ..... 399/258, 260, 262, 105, 106
See application file for complete search history.

(56) References Cited

U.S. PATENT DOCUMENTS 4,360,114 A * 11/1982 Owens
4,461,392 A * 7/1984 Conti
4,917,269 A * 4/1990 Fuchs et al.
4,955,316 A 9/1990 Asanuma et al.
5,109,254 A 4/1992 Oka et al.
5,402,207 A * 3/1995 Michlin
5,630,198 A 5/1997 Makino
5,909,610 A 6/1999 Yoshiki et al.
6,185,401 B1 2/2001 Kanamori et al.
6,298,208 B1 10/2001 Kawamura et al.
7,055,708 B1 * 6/2006 Haffner et al.
7,548,710 B2 6/2009 Gayne et al.
7,606,520 B2 10/2009 Dawson
2008/0170887 A1 * 7/2008 Nishimura et al. ..... 399/262
2009/0245851 A1 * 10/2009 Hoshi et al.
2009/0245883 A1 10/2009 Koido et al.
2013/0170862 A1 7/2013 Leemhuis et al.
2013/0170863 A1 7/2013 Leemhuis et al.

OTHER PUBLICATIONS

International Search Report and Written Opinion of the International Searching Authority dated Jan. 28, 2013 for PCT Application No. PCT/US12/65145 (8 pages).

* cited by examiner

*Primary Examiner* — David Gray
*Assistant Examiner* — Milton Gonzalez
(74) *Attorney, Agent, or Firm* — John Victor Pezdek; Justin M Tromp

(57) ABSTRACT

An shutter having an overmolded seal for use in controlling the flow of toner through a port in a toner containing supply items for an imaging apparatus. In one form the shutter is overmolded with a seal comprised of a sleeve and one or more integrally molded angled endless ribs projecting outwardly from the sleeve. With the shutter installed in the supply item, the ribs deflect creating an sealing interface with the housing of the supply item to prevent toner leakage between the shutter and the housing of the supply item.

18 Claims, 9 Drawing Sheets

OVERMOLDED SHUTTER FOR USE IN TONER CONTAINING SUPPLY ITEMS OF AN IMAGING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to toner cartridges and developer units used in electrophotographic imaging devices such as a printer or multifunction device having printing capability, and in particular shutters used to open and close toner ports on such toner cartridges and developer units.

2. Description of the Related Art

In toner cartridge design it is now common practice to separate the longer lived components from those having a shorter life. This has led to having the longer lived developing components such as the developer roll, toner adder rolls, doctor blades, the foregoing are also referred to as a developing unit, photoconductive drums, cleaning and charge rollers and a waste bin to be in separate assemblies from the toner cartridge. The toner supply, which is consumed relatively quickly in comparison to the previously described components, is provided in a reservoir in a separate toner cartridge that mates with the developer unit. The toner cartridge has a reduced number of components and is often referred to as a toner bottle even though it is more than a mere bottle for holding toner. Because both the developer unit and toner cartridge are each separable and removable from the imaging apparatus, both use shutter assemblies to open and close their respective toner entry port and toner exit port.

To deliver the toner from the toner cartridge to the developer unit, an auger in the toner cartridge may be used to feed toner from the toner cartridge via an exit port on the toner cartridge into an entry port on the developer unit and into a second auger that disperse the toner within the developer unit. As the toner is drawn out of the cartridge unit, it is augured through a shutter. The shutter in one position seals the exit port of the toner cartridge when it is not inserted in the imaging apparatus. Another shutter may be used for sealing the entry port of the developer unit when the toner cartridge has been removed.

The shutters in such shutter assemblies are rotatably mounted in the housings of the toner cartridge and the developer unit and are generally tapered or conical. This mounting requires that the spacing between the shutter and the housing be sealed in order to prevent a toner leak path from occurring between the shutter and the housing. Prior seals have been made from foam materials that are adhesively wrapped around the exterior of the shutter or rubber O-rings were used.

One problem with the traditional application of foam seals or O-rings is that it is difficult to have low frictional force between the shutter and the housing while maintaining proper sealing performance. Additionally, in some cases there are space constraints between the shutter and housing making it difficult to insert the shutter having a foam seal into the housing. The use of wrapped foam seals and O-ring seals result in high rotational frictional force during actuation of the shutter for opening and closing the toner port. This high frictional force must be overcome by a large force applied to the toner cartridge supplied by the shutter operator such as a plunger on a door of the imaging apparatus or by an arbor spring on the developer unit. If not, this will lead to risk of the shutter not fully opening which will impact the rate at which toner can be delivered or not fully closing which will increase the risk of toner leakage.

Another problem with the wrapped foam application is it is difficult to wrap a foam seal around a conically shaped shutter while aligning the mating joints and aligning the seal openings with the port openings in the shutter. This process can result in excessive rotational frictional force, foam misalignment and toner leakage.

To provide a seal for a supply item having a high effective sealing force without a high rotation frictional force would be advantageous. It would be a further advantage to have such a seal to prevent toner escaping from the supply item, such as a toner cartridge or developer unit, during shipping, storage, and when removed from the imaging apparatus. It would be a further advantage to be able to provide a shutter that will open fully to ensure a high rate of toner delivery.

SUMMARY

A shutter is shown for mounting in a housing of a supply item for an imaging apparatus. The shutter, when installed, is rotatable between a first position and a second position for closing and opening a port within the housing through which toner can flow. The shutter comprises a body including a cylindrical hollow portion, the hollow portion sized to be received within a corresponding opening in the housing adjacent the port, the hollow portion having a first opening and a second opening forming a channel therebetween for carrying toner wherein, when the shutter is in the first position, the first and second openings are not in fluid communication with the port and, when the shutter in the second position, one of the first and the second openings is in fluid communication with the port allowing for toner to pass through the port; and a seal overmolded onto the exterior of the body. The seal comprises a sleeve molded around the exterior of the body and positioned upstream of the one of the first and second openings that is in fluid communication with the port; and an endless rib molded on the sleeve, extending outwardly at an acute angle from the sleeve and having a height that is greater than a height of a gap formed between the body and a corresponding opening in the housing when the shutter is installed in the housing. When the shutter is installed in the opening in the housing, the endless rib deflects forming a sealing interface with the housing.

A plurality of gusset ribs may be spaced about the endless rib with each gusset rib molded between a face of the endless rib and the sleeve. The endless rib may be angled in one of a downstream orientation and an upstream orientation. A plurality of endless ribs may be provided, with endless ribs positioned upstream and downstream of the opening in the shutter that is in fluid communication with the port. The seal may be molded from a material selected from a group consisting of thermoplastic elastomers (TPE), thermoplastic urethanes, thermoplastic vulcanizates and silicon rubber. In a further embodiment, the endless rib may have a number of different rib profiles including a C-shaped profile and an S-shaped profile. Scoring on the outer surface of the shutter body may be provided to increase adherence of the molded seal to the surface of the shutter body.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
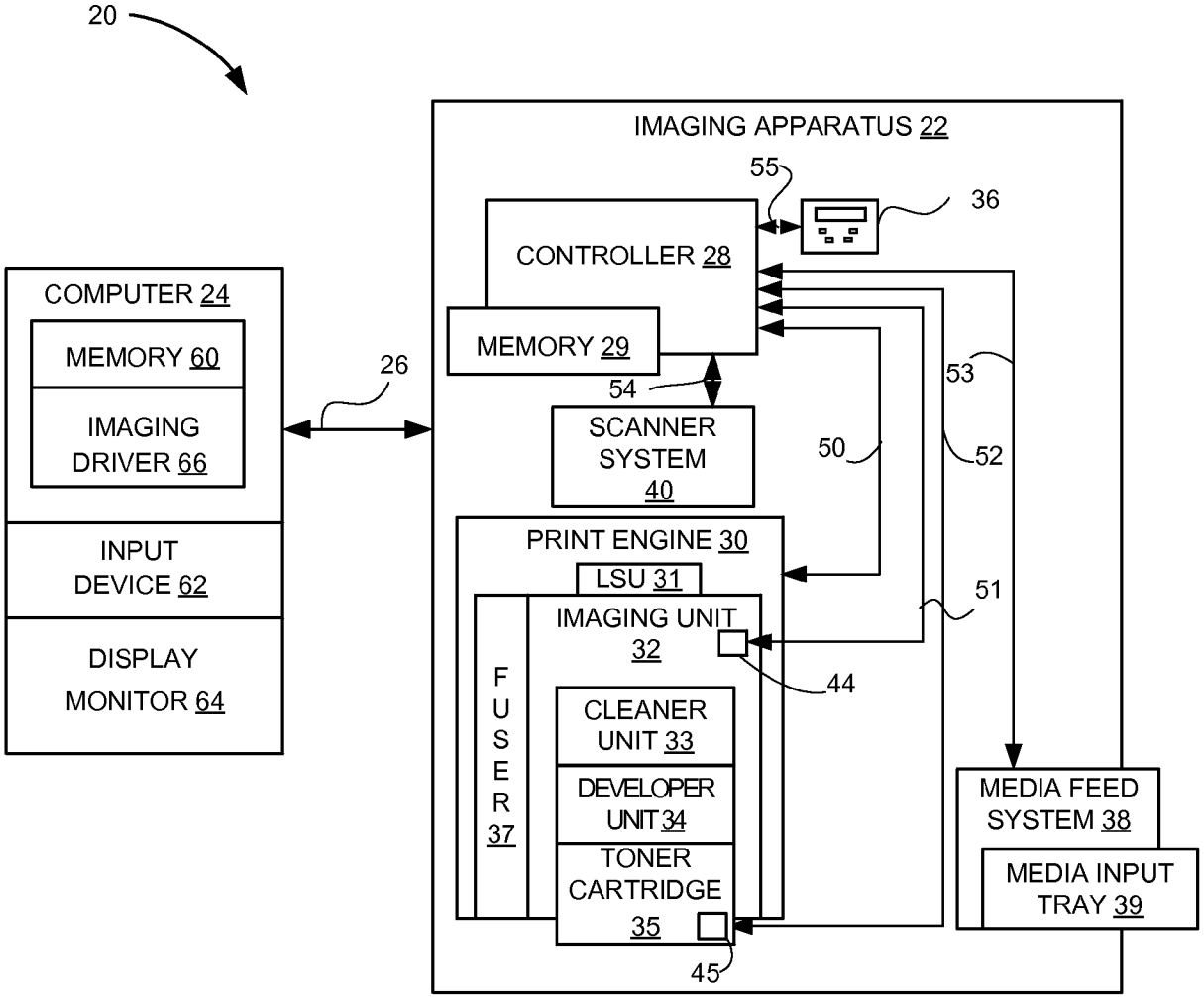
FIG. 1 is a block diagram of an example imaging system having an imaging unit and toner cartridge.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an imaging device. The terms "left" and "right" are as viewed with respect to the insertion direction of a unit into the imaging device. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The term "image" as used herein encompasses any printed or digital form of text, graphic, or combination thereof. The term "output" as used herein encompasses output from any printing device such as color and black-and-white copiers, color and black-and-white printers, and so-called "all-in-one devices" that incorporate multiple functions such as scanning, copying, and printing capabilities in one device. The term "button" as used herein means any component, whether a physical component or graphic user interface icon, that is engaged to initiate output.

Referring now to the drawings and particularly to FIG. 1, there is shown a diagrammatic depiction of an imaging system 20 embodying the present invention. As shown, imaging system 20 may include an imaging apparatus 22 and a computer 24. Imaging apparatus 22 communicates with computer 24 via a communications link 26. As used herein, the term "communications link" is used to generally refer to structure that facilitates electronic communication between multiple components, and may operate using wired or wireless technology and may include communications over the Internet. Imaging system 20 may be, for example, a customer imaging system, or alternatively, a development tool used in imaging apparatus design.

In the embodiment shown in FIG. 1, imaging apparatus 22 is shown as a multifunction machine that includes a controller 28, a print engine 30, a laser scan unit (LSU) 31, an imaging unit 32, a cleaner unit 33, a developer unit 34, a toner cartridge 35, a user interface 36, a media feed system 38 and media input tray 39 and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40; or a standalone scanner system 40.

Controller 28 includes a processor unit and associated memory 29, and may be formed as one or more Application Specific Integrated Circuits (ASICs). Memory 29 may be any volatile on non-volatile memory or combinations thereof such as, for example, random access memory (RAM), read only memory (ROM), flash memory, and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuits 44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, network server, tablet computer, smartphone or other hand-held electronic device, including memory 60, such as volatile and/or non-volatile memory, input device 62, such as a keyboard, and a display, such as monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include a laser scan unit (LSU) 31, an imaging unit 32, a toner cartridge 35, and a fuser 37, all mounting within imaging apparatus 22. The imaging unit 32 further includes a cleaner unit 33 housing a waste toner removal system and a photoconductive drum, and a developer unit 34 that are removably mounted within imaging unit 32. In one embodiment the cleaner unit 33 and developer unit 34 are assembled together and installed into a frame forming the imaging unit 32. The toner cartridge 35 is then guided by the frame into a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

The toner cartridge 35 removably mates with the developer unit 34 in imaging unit 32. An exit port on the toner cartridge 35 communicates with an entry or inlet port on the developer unit 34 allowing toner to be periodically transferred from the toner cartridge 35 to resupply the toner sump in the developer unit 34.

Figure 2:
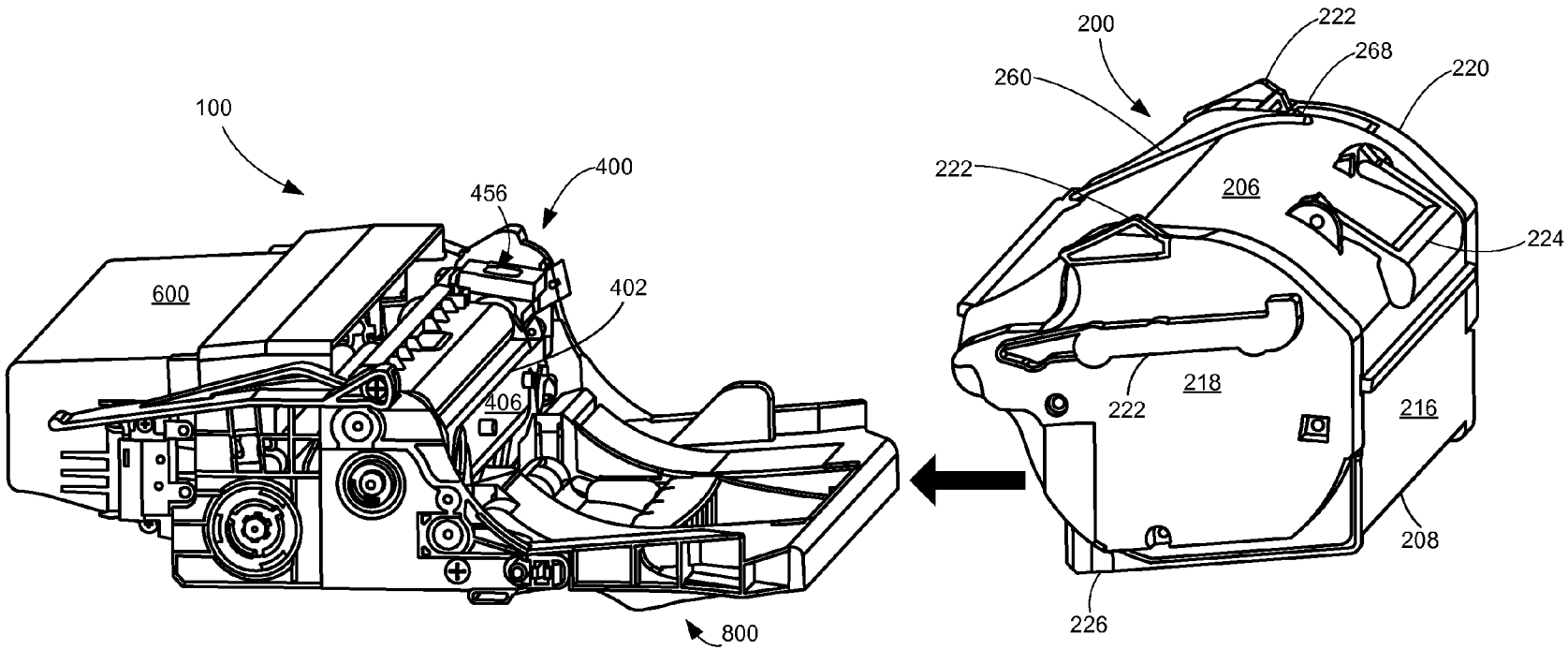
FIG. 2 is an illustration of one embodiment of an imaging unit and toner cartridge.

Referring now to FIG. 2, an example embodiment of the imaging unit 100 is shown. Imaging unit 100, as illustrated, comprises developer unit 400, a cleaner unit 600 and a frame 800. Developer unit 400 and cleaner unit 600 are assembled together with frame 800, with toner cartridge 200 being slidably received on frame 800. The imaging unit 100 is initially slidably received in the imaging apparatus 22. The toner cartridge 200 is guided by frame 800 into operative engagement with the developer unit 400. This arrangement allows the toner cartridge 200 to be removed and reinserted easily when replacing an empty toner cartridge without having to remove imaging unit 100. Should a media jam occur beneath the imaging unit 100, the toner cartridge 200 and imaging unit 100 may be readily removed to allow access to the media jam. The developer unit 400, cleaning unit 600 and frame 800 may also be readily removed and reinserted when required; however, this would normally occur with less frequency than the removal and reinsertion of toner cartridge 200.

Figure 3:
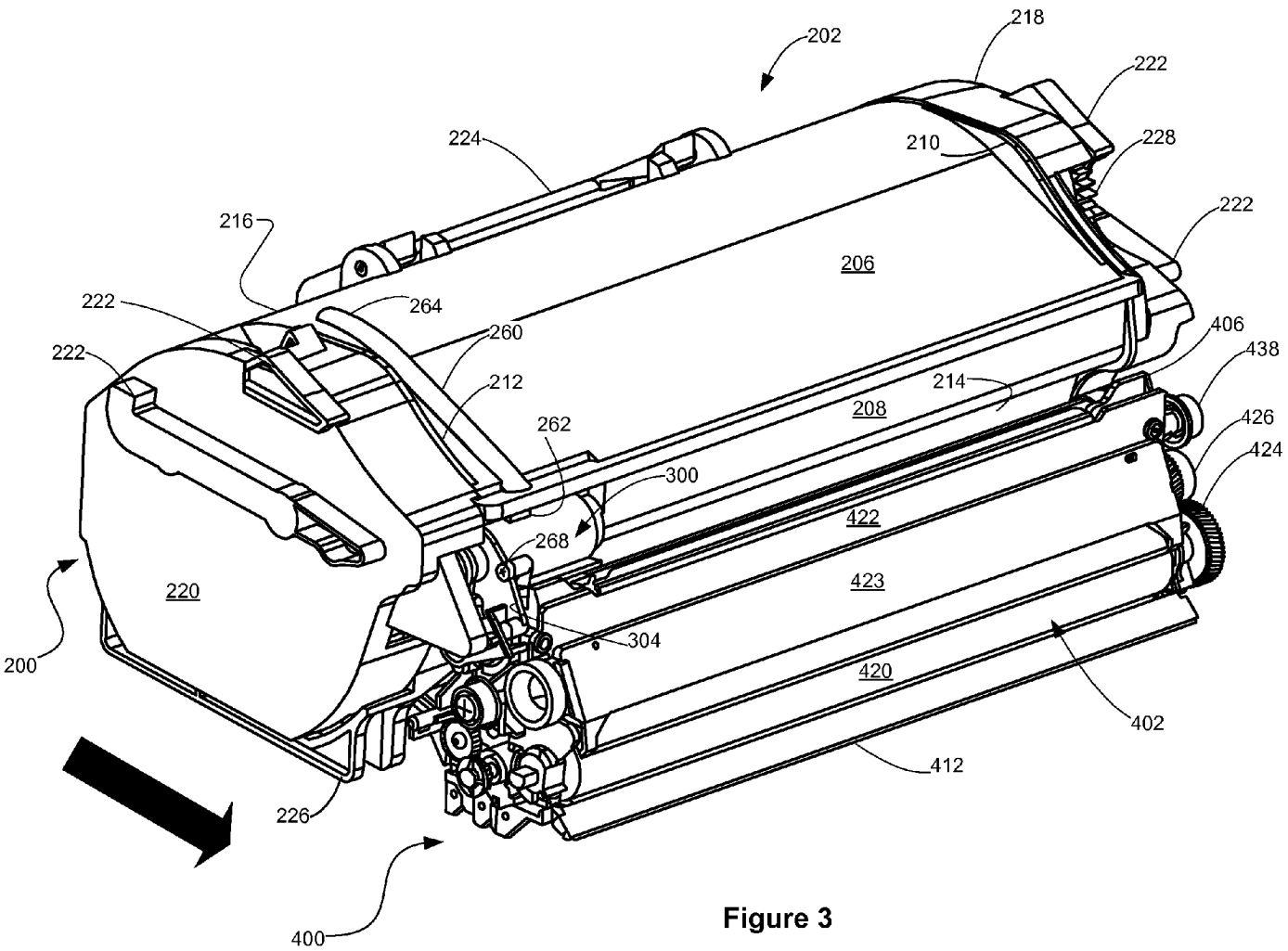
FIG. 3 is an illustration of the combination of a toner cartridge and a developer unit utilizing shutter assemblies.
Figure 4:
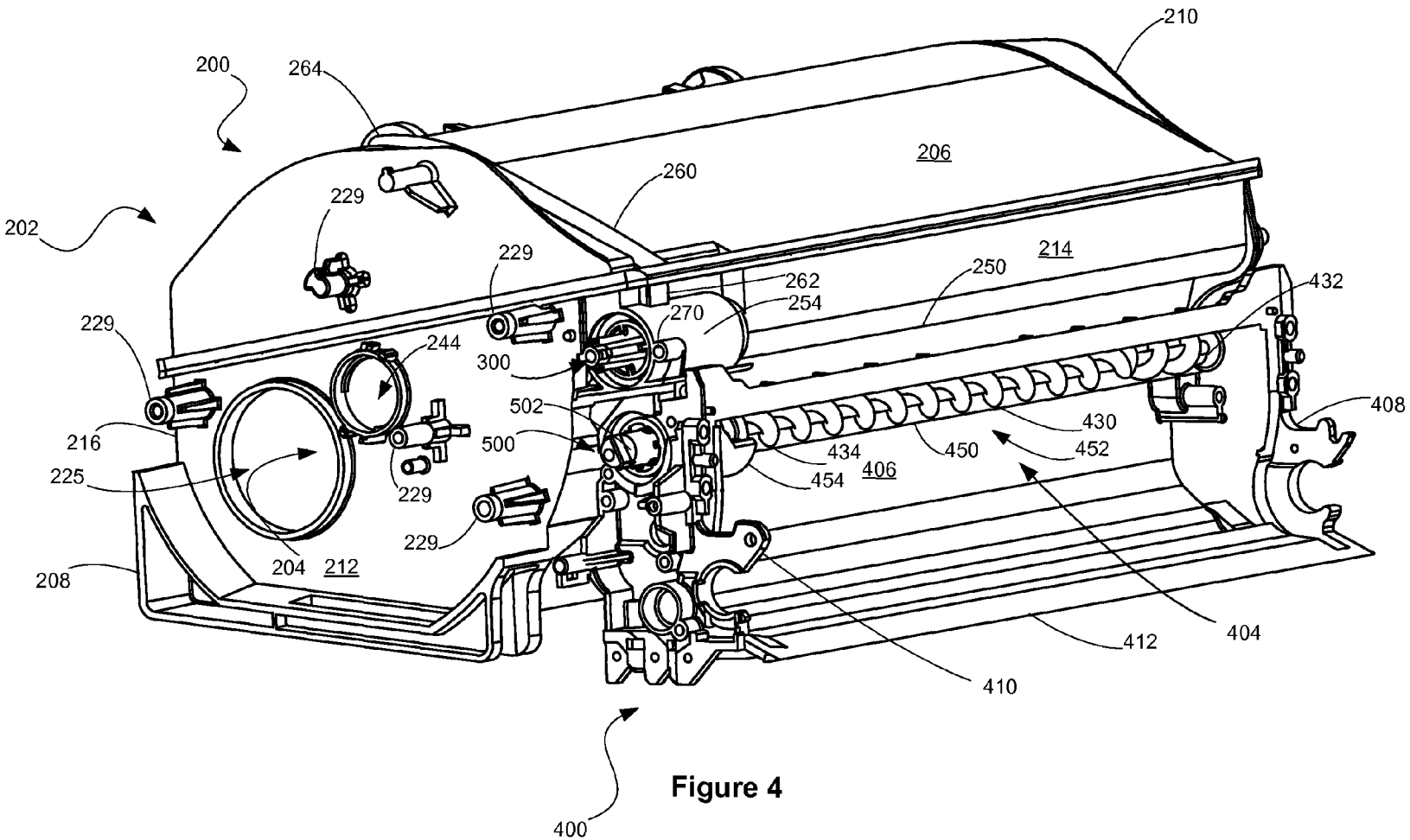
FIG. 4 is an illustration of the toner cartridge and developer unit of FIG. 3 shown in a partially assembled condition.

In FIGS. 3 and 4, an example embodiment of the toner cartridge 200 and developer unit 400 is shown. For simplicity, cleaner unit 600 and frame 800 are not shown. The large arrow shown in FIG. 3 indicates the insertion direction of the cartridge 200 into the frame 800 where it mates with developer unit 400 of the imaging unit 100. The arrow also points toward what is termed the "front" of these various elements. Toner cartridge 200 comprises a housing 202 having a reservoir 204 enclosed therein (see FIG. 4) for holding a quantity of toner. Housing 202 may be viewed as having a top or lid 206 mounted on a base 208. Base 208 includes first and second side walls 210, 212, connected to adjoining front and rear walls 214, 216. Top 206 may be ultrasonically welded to base 208 forming reservoir 204. First and second end caps 218, 220 are also mounted to housing 202 and include guides 222 to assist with supporting and inserting toner cartridge 200 for mating with developer unit 400. First and second end caps 218, 220 may be snap fitted into place or attached by screws or other forms of fasteners. Guides 222 travel in channels provided within the housing of the imaging apparatus so that toner cartridge 200 does not load down the developer unit 400. Guides 226 may also be provided on base 208 to assist with insertion and removal of toner cartridge 200. A handle 224 may be provided on top 206 to assist with insertion and removal of toner cartridge 200 from the imaging unit 100. A fill port 225 is provided on second side wall 212 and is used to fill toner reservoir 204 with toner. After filling, fill port 225 would be closed by a plug or cap.

Various drive gears are housed within a space formed between first end cap 218 and first side wall 210 with main interface gear 228 being visible. Various interlocks and linkages may also be housed within the space formed between second end cap 220 and second side wall 212. Mounting structures 229 may be provided on the exterior surfaces of first and second side walls 210, 212 for use with the interlocks and linkages. Main interface gear 228 engages with a drive system within imaging apparatus 22 which provides torque to main interface gear 228. A paddle is rotatably mounted within toner reservoir 204 with first and second ends of a drive shaft of the paddle extending through aligned openings 244 in the first and second side walls 210, 212, respectively. A drive gear is provided on the first end of the drive shaft of the paddle and engages with main interface gear 228 either directly or via one or more intermediate gears. First side wall 210 may also be termed the "drive" or "driven" side of toner cartridge 200.

A channel extending along the width of front wall 214 between the first and second side walls 210, 212 houses an auger and a shutter assembly 300. In one embodiment channel 250 is positioned above the axis of rotation of the drive shaft of the paddle. Channel 250 may be integrally molded as part of front wall 214 or be formed as a separate component that is attached to front wall 214. Channel 250 is generally horizontal in orientation along with toner cartridge 200 when toner cartridge 200 is installed in imaging unit 100. An end of the auger extends through first side wall 210 and a drive gear is provided which engages with main interface gear 228 either directly or via one of more intermediate gears. A bushing may be provided where the end of the auger passes through first side wall 210. A similar bushing may be provided on each of the ends of the paddle where they pass through the first and second side walls 210, 212. Shutter assembly 300 is provided on the front wall 214 of housing 202 adjacent side wall 212 at one end of channel 250.

Referring also to FIG. 4, channel 250 comprises an open portion and an enclosed portion 254. The open portion is open to the toner reservoir 204 and extends from the first side wall 210 toward the second side wall 212 to the shutter assembly 300. Enclosed portion 254 of channel 250 extends from the second side wall 212 and encloses a shutter 302 of shutter assembly 300. The paddle, as it rotates, delivers toner from the toner reservoir 204 into the open portion of channel 250. The auger rotates to deliver toner received in channel 250 to the shutter 302 which is housed in the enclosed portion 254 of channel 250. An exit port 256 is provided through the wall 258 forming the enclosed portion 254 of channel 250. Shutter 302 rotates between a first position where it closes exit port 256 and a second position where exit port 256 is open. As illustrated, exit port 256 is disposed at the bottom of channel 250 so that gravity will assist in having toner exit through exit port 256.

Figure 6:
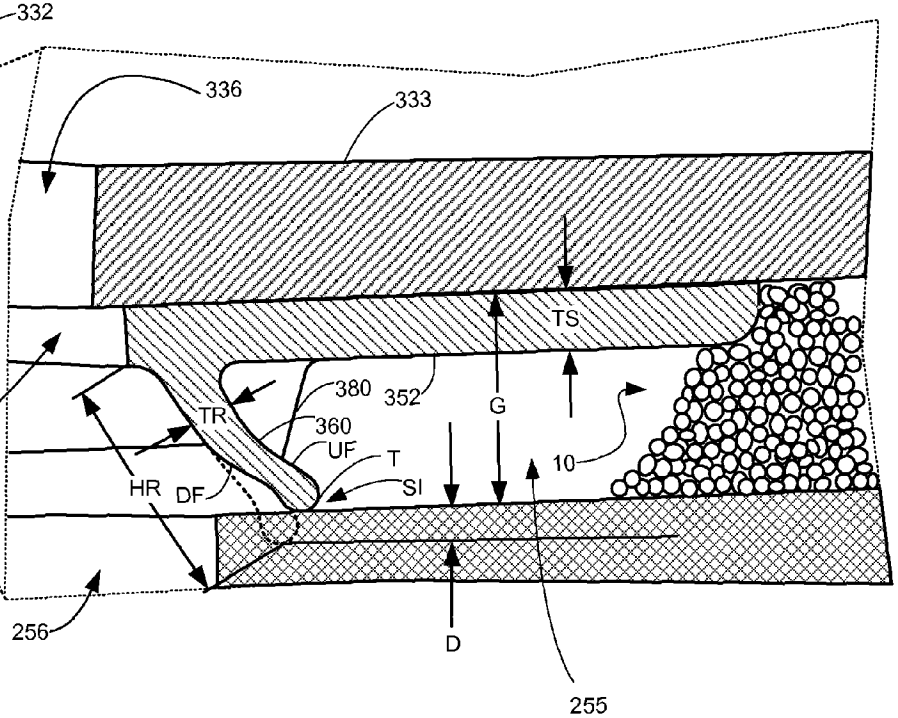
FIG. 6 is a close-up view of a portion of FIG. 5 illustrating the interface between the toner cartridge housing and the overmolded shutter.
Figure 5:
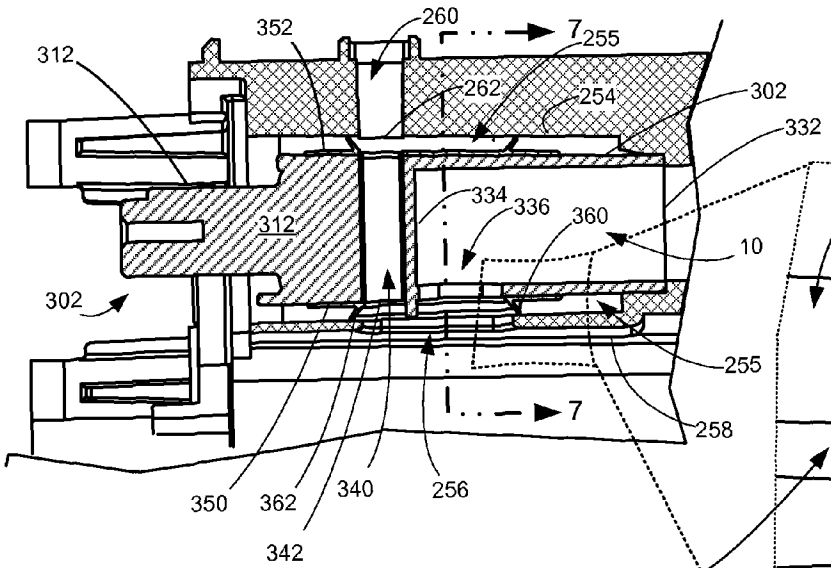
FIG. 5 is a partial sectional view of a toner cartridge shutter assembly shown in FIG. 4 having one embodiment of an overmolded shutter of the present invention.
Figure 7:
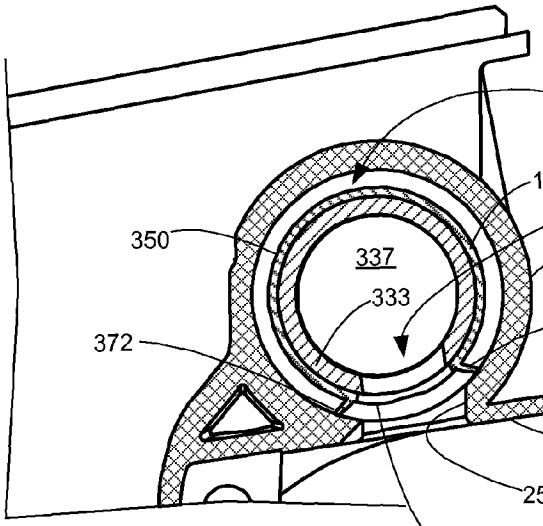
FIG. 7 is sectional view taken along line 7-7 of FIG. 4 illustrating the axial and endless ribs of the overmolded shutter in one embodiment of the present invention.
Figure 8:
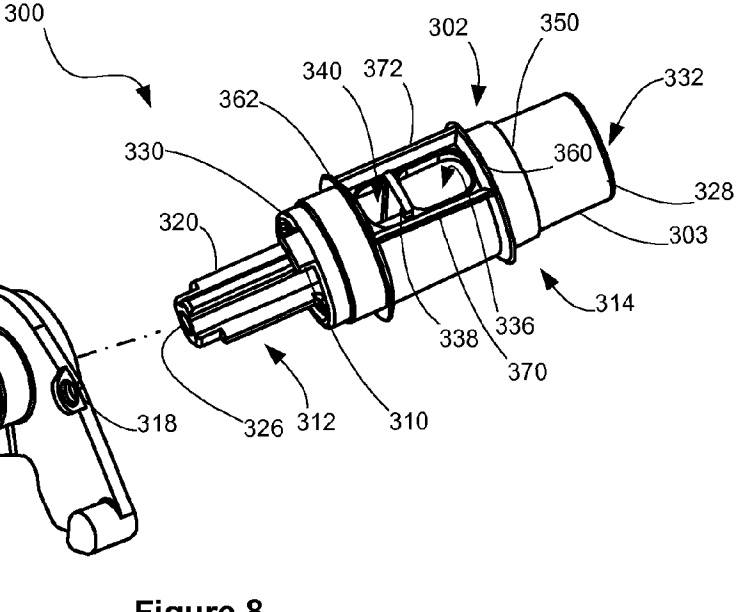
FIG. 8 is an exploded view of the shutter assembly illustrated in FIGS. 4-6.

Referring to FIGS. 5-7, a passageway 260, separate from channel 250, is provided in the housing 202 from the shutter assembly 300 to the toner reservoir 204. In FIG. 5 shutter 302 is in fully opened or second position. As illustrated, passageway 260 extends between shutter assembly 300 to about the apex of the lid 206. A first end 262 of the of passageway 260 is in fluid communication with the enclosed portion 254 of channel 250 while a second end 264 of passageway 260 is in fluid communication with reservoir 204 and disposed above the toner contained within the reservoir 204 to reduce possible blockage of the second end 264 of passageway 260 by the toner. Passageway 260 is routed away from the path along which toner is delivered so that it will not become blocked by toner exiting toner cartridge 200. A one-way valve that is biased to close is provided at the second end 264 of passageway 260 but is openable by air traveling along passageway 260 from developer unit 400 allowing the air to enter into toner reservoir 204. Passageway 260 and a duct in the shutter 302 form an airway to allow higher pressure air to exit from the developer unit 400 and enter into reservoir 204.

Referring to FIGS. 5-11, an example shutter assembly 300 having an overmolded shutter 302 for the toner cartridge 200 is shown. Shutter assembly 300 includes a shutter 302, a retainer 304 and a lever 306. In general, lever 306 is used to move shutter 302 between a first position where the exit port 256 is closed to channel 250 and a second position where the exit port 256 is open to channel 250. A linkage (not shown) housed in second end cap 220 actuates lever 306 to move shutter 302 between the first and second positions during insertion and removal of toner cartridge 200. A stop 310 is provided on one end of the shutter body 303, as shown, on drive portion 312. Stop 310 travels in a channel provided in retainer 304. The length of the channel in retainer 304 limits the travel of shutter 302 to between the first and second positions. Other forms of travel stops and other locations for the stop may be used as is known in the art.

In an example embodiment shutter 302 has a generally cylindrical body 303. Shutter body 303 has a drive portion 312 and a hollow portion 314. Shutter 302 is inserted into the enclosed portion 254 of channel 250 in housing 202 aligning the hollow portion 314 of shutter 302 with an end of the auger. Shutter 302 is rotatable within enclosed portion 254 of channel 250. Drive portion 312 passes through an opening 316 in retainer 304 and is rotatable within opening 316. Fasteners 268 are inserted through openings 318 in retainer 304 and are received in corresponding openings 270 in housing 202 rotatably securing shutter 302 in housing 202 (see FIGS. 3 and 4). Drive portion 312 has one or more keys 320 that are received into corresponding one or more keyways 324 in opening 322 of lever 306 to ensure proper orientation of lever 306 with shutter 302. Another fastener 308, such as a screw, passes through openings 322, 316 and is received in opening 326 provided on the end of drive portion 312 securing lever 306 to shutter 302. A connection pin 325 is provided at the distal end of lever 306 for attaching a drive linkage used for operating of lever 306. It will be realized that alternatively one or more keys may be provided on lever 306 and be received in corresponding one or more keyways provided in drive portion 312 of shutter 302. Other forms of fasteners may also be used.

Hollow portion 314 extends from an inner end 328 of the shutter 302 toward an outer end 330 of the shutter 302 and has an open end 332 and a closed end 334. Open end 332 and hollow portion 314 are sized to rotatably receive an end of the auger and provide support for the auger. Exit opening 336 is provided through a wall 333 of hollow portion 314. A channel 337 is formed in shutter 302 between the open end 332 and exit opening 336 through which exiting toner passes on its way to the exit port 256. When the shutter 302 is in its second or open position, rotation of the auger pushes toner in channel 250 through channel 337 and out exit opening 336 where it falls through exit port 256. FIGS. 5 and 7 illustrate the position of shutter 302 when in its second position or open position in toner cartridge 200. When in its first position or closed position in toner cartridge 200, the shutter 302 would be rotated approximately ninety degrees.

A duct 340 having first and second ends 342, 344 passes through shutter 302 and is disposed within drive portion 312. First end 342 of duct 340 is positioned near exit opening 336. Example duct 340 is shown routed through shutter 302 along a diameter thereof and does not intersect with channel 337. However, other routings for duct 340 may be used through drive portion 312 of shutter 302. In one embodiment a deflection rib 338 is disposed near closed end 334 of hollow portion 314. Deflection rib 338 directs toner leaving exit opening 336 away from first end 342 of duct 340 and into exit port 256. Deflection rib 338 may extend into exit port 256. Deflection rib 338 helps to block exiting toner leaving exit opening 336 from entering duct 340. Shutter body 303 may be cylindrical or may taper slightly inwardly along the hollow portion 314.

The outer dimension of the shutter body 303 is smaller than the dimension of the opening in the enclosed portion 254 of channel 250 in housing 202 forming a gap G therebetween (see FIG. 6). The gap G allows the shutter 302 to be rotated between its first and second positions but creates a toner leak path. The upstream end of leak path is at the end of channel 250 adjacent the inner end 328 of shutter body 303, and flows downstream through the gap G to the port 256 in the housing 202. Foam seals and O-ring seals have been used to seal the gap G, however, these seals exhibit the problems previously described. An overmolded seal having ribs may be provided on shutter 302 and be used to provide an effective seal while having a reduced frictional contact area with the housing allowing for lower torque to operate the shutter 302. Overmolded seal 350 is used to seal the space 255 between shutter body 303 and the enclosed portion 254 of channel 250 to prevent the leakage of toner around exit port 256.

Referring again to FIGS. 2-4, a shutter assembly 500 similar to shutter assembly 300 may also be used in the developer unit 400. The developer unit 400, illustrated in a partially assembled state in FIG. 4, comprises a housing 402 having a toner sump 404 formed by a rear wall 406, first and second side walls 408, 410 and bottom 412. A developer roll 420, doctor blade 422 and toner adder roll are mounted between first and second side walls 408, 410. The doctor blade 422 provides a metered uniform layer of toner on the surface of developer roll 420. The developer roll 420 and doctor blade 422 enclose the toner sump 404. A cooling duct 423 is positioned in front of doctor blade 422 and atop developer roll 420. Duct 423 has nozzles at each end directed at the ends of the developer roller and its seals and provides cooling to the seals. A drive gear 424 is provided on one end of developer roll 420. The toner adder roll which is hidden behind the doctor blade 422 is driven by gear 426. An auger 430 having first and second ends 432, 434, and a spiral screw flight 436 is received within a channel 450 extending along the width of rear wall 408 near the top of rear wall 408. A first end 432 of the auger 430 extends through first side wall 408 and a drive connection 438 is provided to rotate auger 430. Drive gears 424 and 426 receives torque from the imaging apparatus. The cleaner unit 600, which would be in front of the developer unit 400, and frame 800 are not shown.

A channel 450 for delivery toner from an entry port 456 (see FIG. 2) comprises an open portion 452 and an enclosed portion 454. Open portion 452 is open to the toner sump 404 and extends from the first side wall 408 toward the second end 434 of auger 430. Enclosed portion 454 of channel 450 extends from the second side wall 410 and encloses a shutter 502 of shutter assembly 500, the second end 434 of the auger 430 and is in fluid communication with the entry port 456. Auger 430 is rotated via drive gear 438 to deliver toner received in shutter 502 into the open portion 452 of channel 450 and then into toner sump 404. Shutter 502 rotates between a first position where it closes entry port 456 and a second position where entry port 456 is open. As illustrated entry port 456 is disposed at the top of channel 450 so that gravity will assist in having toner drop through entry port 456 and into the shutter. Shutter 502 is similarly constructed to shutter 302 except that the toner flow path is reversed from that in shutter 302. For shutter 502, toner drops through an exit opening in the wall of a hollow portion of the shutter 502 and into in a channel extending between the entry opening and an open end of the shutter. Toner and exits into channel 450 where auger 430 distributes the toner into the toner sump 404. Shutter 502 is provided with an overmolded seal as previously described for shutter 302.

Figure 11:
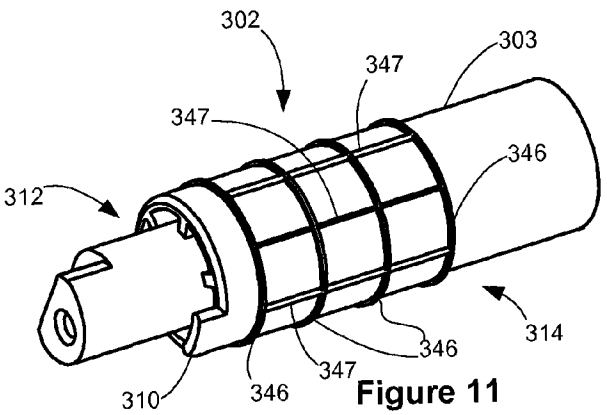
FIG. 11 is a perspective view illustrating scoring on the shutter body prior to overmolding of the seal onto the shutter.
Figure 9:
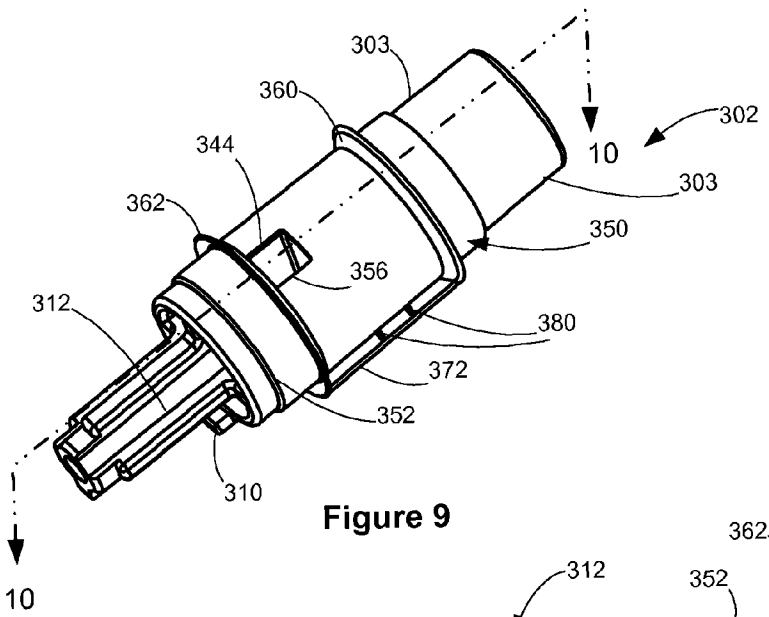
FIG. 9 is a perspective view of a shutter and overmolded seal showing a second end of an air duct.
Figure 10:
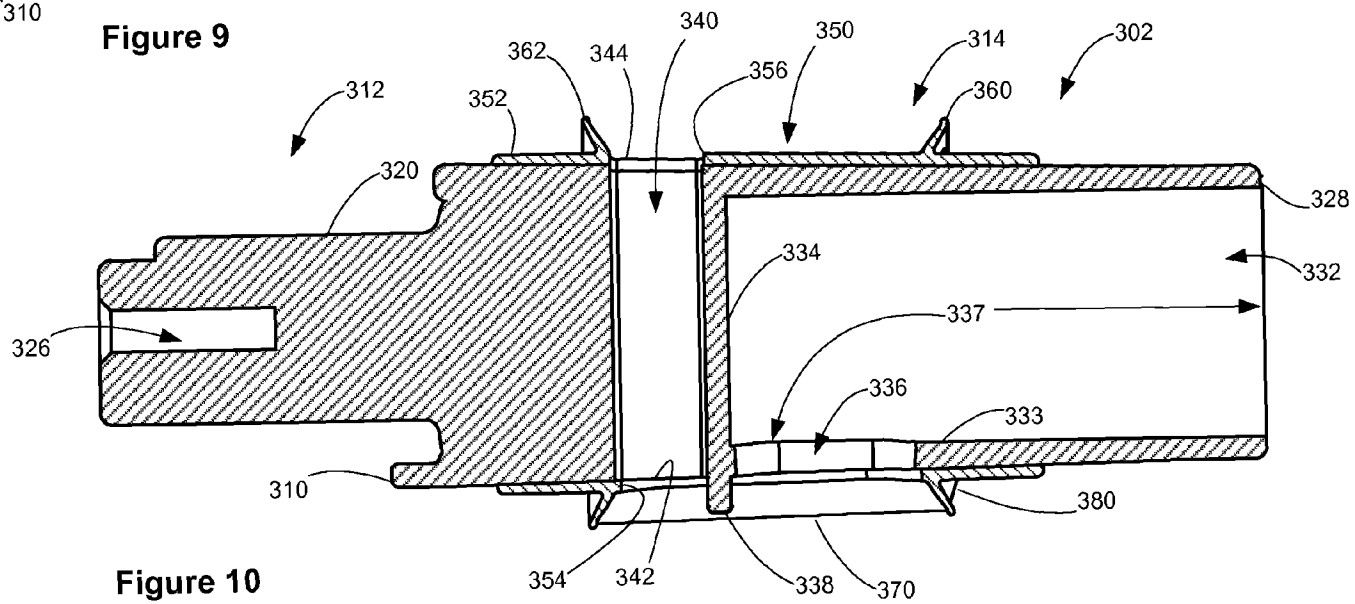
FIG. 10 is a sectional view of the shutter of FIG. 9 taken along section line 10-10 in FIG. 9.

Referring to FIGS. 5-11, an example overmolded seal 350 is shown overmolded onto body 303 of shutter 302. In one form seal 350 is comprised of a sleeve 352 having one or more endless ribs 360 that is positioned upstream of the exit opening. The sleeve may extend along the length of the shutter body 303 and would have openings therethrough corresponding with the openings in the shutter body 303. As illustrated, sleeve 352 would have opening 354 corresponding to exit opening 336 and first end 342 of duct 340 and other opening 356 corresponding to the second end 344 of duct 340 in shutter body 303, if present. The ribs are "endless" because they are continuous and have no ends, joints or gaps. Ends, joints or gaps in these ribs are potential areas through which toner may leak. Endless ribs 360 are in one form generally circular or annular in a plane orthogonal to the rotational axis of the shutter body 303 but may follow other paths around the perimeter of the shutter body 303 or be on non-orthogonal planes to the rotational axis of the shutter body 303. Sleeve 352 conforms to the shape of the surface of shutter body 303 and has a thickness TS that is less than the height of gap G. As illustrated in FIG. 11, the outer surface of shutter body 303 may be provided with one or more annular ribs 346, and/or one or more axial ribs 347. A rectangular windowpane grid is illustrated. Other scoring and grid patterns are a matter of design choice. The annular and axial ribs 346, 347 prevent the sleeve of seal 350 from slipping with respect to shutter body 303 during insertion into the housing and during operation of the shutter 302. In the illustrated example, ribs 346, 347 are provided on hollow portion 314 of shutter body 303. Grooves may also be scored into the surface of shutter body 303 and used in lieu of the ribs 346, 347 or in combination with them. Other forms of ribs and grooves may also be used such as a spiral rib or spiral groove alone or with the endless and axial ribs 346, 347. The shape, spacing, and height or depth of the ribs and grooves is also a matter of design choice.

In one form, the overmolded seal 350 comprises a sleeve 352 having single endless rib 360 is positioned upstream of the exit opening 336 and downstream of the inner end 328 of the shutter body 303 and is used to block the flow of toner 10 along the potential leak path. Rib 360 has an upstream face UF and a downstream face DF. "Upstream" and "downstream" are relative to the direction of toner flow along a toner leak path. As one of skill in the art would recognize, the sleeve 352 of seal 350 shown in FIG. 5 would be narrower and be provided upstream of exit opening 336. As best seen in FIG. 6, the rib 360 projects outwardly at an angle from an outer surface of the sleeve 352. Rib 360 has a height HR shown by the dashed outline of the tip of rib that is greater than the height of gap G within the space 255. With shutter body 303 installed in the housing 202, the tip T of rib 360 deflects by an amount D forming a sealing interface SI with the housing 202, specifically the inner surface of the enclosed portion 254 of channel 250. The effective sealing force may be controlled by the amount of deflection D and the resiliency of the material used in forming the endless and transverse ribs. For the shutter body 303 shown in FIGS. 5-10, sleeve 352 has openings 354, 356 therethrough. Opening 354 is disposed about both the first end 342 of duct 340 and exit opening 336 while opening 356 is disposed about second end 344 of duct 340. As would be understood depending on the design of the sleeve and its coverage of the surface of the shutter body 303, appropriate openings as required would be provided.

In another form, a second endless rib 362 may be provided downstream of exit opening 336. Endless rib 362 may be angled oppositely from endless rib 360 as illustrated; however it may also be angled in the same manner as rib 360. Rib 362 is also shown as having the same profile and height as rib 360; however, other heights and profiles may be used to provide a different sealing force than that applied by rib 360. Further one or more gusset ribs 380 may be provided between a face on each endless ribs 360, 362 and sleeve 350 to inhibit the endless ribs 360, 362 from rolling or turning during insertion and operation of the shutter.

Also shown in FIGS. 7-10 are transverse or axial ribs oriented general along the axis of rotation of the shutter body 303. A first angled transverse rib 370 is positioned between and joined with endless ribs 360 and 362 adjacent exit opening 336 and the first end 342 of duct 340. A second transverse rib 372 is positioned between and joined with endless ribs 360 and 362 adjacent exit opening 336 and the first end 342 of duct 340 but opposite first transverse rib 370 and is angled oppositely to first transverse rib 370. Transverse ribs 370, 372, along with the portions of endless ribs 360, 362 therebetween, surround exit opening 336 and the first end 342 of duct 340. Because the amount of rotational travel of the shutter body 303 is limited by stop 310, transverse ribs are not provided around the second end 344 of duct 340. However providing additional transverse ribs about the second end 344 of duct 340 would be a matter of design choice.

Second transverse rib 372 may be angled oppositely from first transverse rib 370 as illustrated; however it may also be angled in the same manner as first transverse rib 370. Second transverse rib 372 is also shown as having the same profile and height as first transverse rib 370; however, other heights and profiles may be used to provide a different sealing force than that applied by first transverse rib 370. Further one or more gusset ribs 380 may be provided between each of first and second transverse ribs 370, 372 and sleeve 352 inhibit these transverse ribs from rolling or turning during insertion and operation of the shutter 302. Because transverse ribs 370, 372 are molded as part of seal 350, they are formed integrally with endless ribs 360, 362 so there are no gaps between the ends of the transverse ribs where they meet the endless ribs 360, 362.

Figure 12:
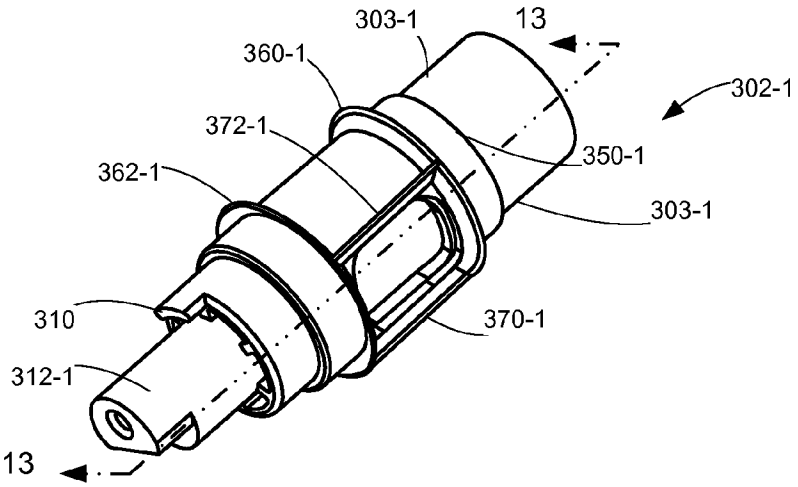
FIG. 12 is a perspective view of an alternative embodiment of an overmolded shutter.
Figure 13:
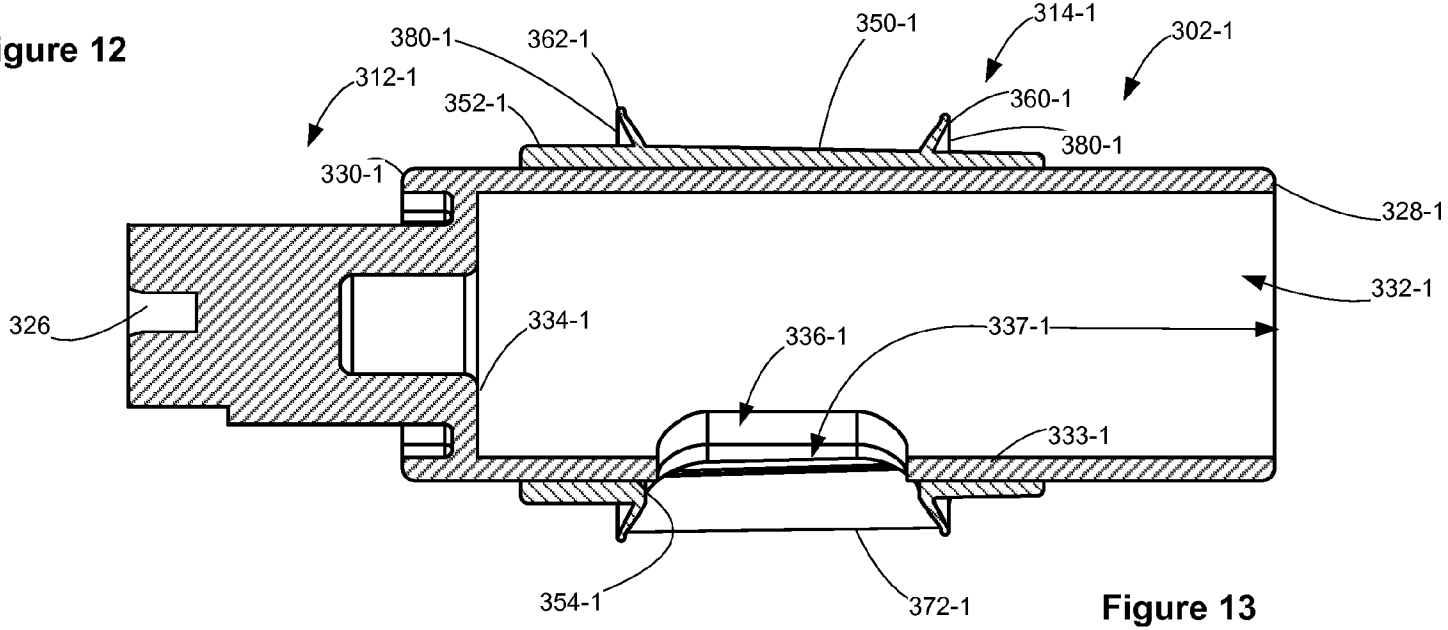
FIG. 13 is a sectional view of the shutter of FIG. 12 taken along section line 13-13 in FIG. 12.

FIGS. 12 and 13 illustrate a further example embodiment of a shutter and overmolded seal. Like reference numerals will be used for like elements. For shutter 302-1, sleeve 352-1 has an opening 354-1. Opening 354-1 is disposed about exit opening 336-1. Again, depending on the design of the sleeve and shutter body 303-1 and its coverage of the surface of the shutter body 303-1, appropriate openings as required would be provided. Shutter body 303-1 has a drive portion 312-1 and a hollow portion 314-1. Hollow portion 314-1 extends from an inner end 328-1 of the shutter 302-1 toward an outer end 330-1 and has [[a]] an open end 332-1 and a closed end 334-1. Open end 332-1 and hollow portion 314-1 are sized to rotatably receive an end of the auger and provide support for the auger. Exit opening 336-1 is provided through a wall 333-1 of hollow portion 314-1. A channel 337-1 is formed in shutter 302-1 between the open end 332-1 and exit opening 336-1 through which exiting toner passes on its way to an exit port. Shutter body 303-1 may be cylindrical or may taper slightly inwardly along the hollow portion 314-1.

Overmolded seal 350-1 comprises a sleeve 352-1 having first and second single endless ribs 360-1, 362-1 that is positioned upstream and downstream respectively of the exit opening 336-1 and is used to block the flow of toner 10 along the potential leak path previously discussed. Endless ribs 360-1, 362-1 project outwardly at an angle from an outer surface of the sleeve 352-1. Second endless rib 362-1 may be angled oppositely from rib 360-1 as illustrated; however it may also be angled in the same manner as rib 360-1. Rib 362-1 is also shown as having the same profile and height as rib 360-1; however, other heights and profiles may be used to provide a different sealing force than that applied by rib 360-1. One or more gusset ribs 380-1 may be provided between each ribs 360-1, 362-1 and sleeve 350-1 to inhibit the ribs from rolling or turning during insertion and operation of the shutter.

A first angled transverse rib 370-1 may be positioned between and joined with endless ribs 360-1 and 362-2 adjacent exit opening 336-1. A second transverse rib 372-1 may be positioned between and joined with endless ribs 360-1 and 362-1 adjacent exit opening 336-1 but opposite first transverse rib 370-1 and is angled oppositely to first transverse rib 370-1. Transverse ribs 370-1, 372-1, along with the portions of endless ribs 360-1, 362-1 therebetween, surround exit opening 336-1. Second transverse rib 372-1 may be angled oppositely from first transverse rib 370-1 as illustrated; however it may also be angled in the same manner as first transverse rib 370-1. Second transverse rib 372-1 is also shown as having the same profile and height as first transverse rib 370-1; however, other heights and profiles may be used to provide a different sealing force than that applied by first transverse rib 370-1. Further one or more gusset ribs 380-1 may be provided between each of first and second transverse ribs 370-1, 372-1 and sleeve 352-1 to inhibit these transverse ribs from rolling or turning during insertion and operation of the shutter 302-1.

Because the endless ribs, and transverse ribs, if used, deflect rather than being compressed between the shutter body and the housing, the rotational frictional force for the deflected ribs is less than that for compressed form or O-rings. In one example configuration, the gap G may be in the range or 0.5 mm to about 3 mm with a nominal value of about 1.175 mm. The height HR of ribs 360, 362, 370, 372 may be in the range of 0.05 mm to about 1 mm with a nominal value of about 0.3 mm while the thickness TS of the sleeve 352 may be in the range of 0.1 mm to about 1.5 mm with a nominal value of about 0.5 mm. The amount of deflection D of the ribs 360, 362, 370, 372, is in the range of 0.05 mm to about 1 mm with a nominal value of about 0.25 mm. As can be appreciated, the shutter body 303 is closely fitted in the enclosed portion 254 of channel 250.

Figure 14:
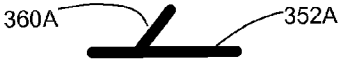
FIGS. 14-18 are example schematic illustrations of endless rib configurations for the overmolded shutter of the present invention.
Figure 15:
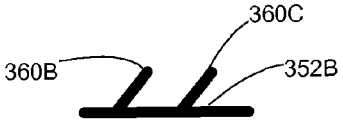
Figure 16:
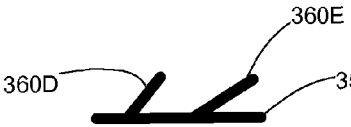
Figure 17:
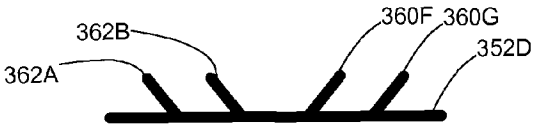
Figure 18:
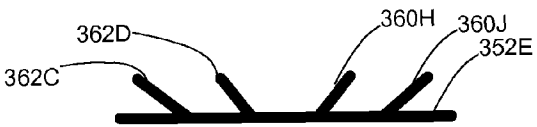

FIGS. 14-18 illustrate various configurations for the endless ribs. FIG. 14 illustrates a sleeve 352A having a single rib 360A. FIG. 15 illustrates a sleeve 352B having a pair of similarly angled ribs 360B, 360C positioned together to form a double seal such as upstream of the exit opening. FIG. 16 illustrates a sleeve 352C having a pair of ribs 360D, 360E angled in the same direction; however rib 360E has a greater height and more acute angle than rib 360D. Ribs 360D, 360E are positioned together to form a double seal. FIG. 17 illustrates a sleeve 352D having two pairs of ribs 360F, 360G and 362A, 362B. Rib pair 360F, 360G are identical and angled in the same direction while rib pair 362A, 362B are identical and angled oppositely to rib pair 360F, 360G. Rib pair 360F, 360G may be positioned together to form a double seal upstream of the exit opening while rib pair 362A, 362B may be positioned downstream of an exit opening. FIG. 18 illustrates a sleeve 352E having two pairs of ribs 360H, 360J and 362C, 362D. Rib pair 360H, 360J are angled in the same direction however rib 360J has a greater height and more acute angle than rib 360H. Rib pair 362C, 362D are angled oppositely to rib pair 360H, 360J. Rib 362C has a greater height and more acute angle than rib 362D. Rib pair 360H, 360J may form a double seal upstream of the exit opening while rib pair 362C, 362D may be positioned downstream of an exit opening. These endless rib configurations are not meant to be limiting and other configurations of the endless ribs may be employed as one of ordinary skill in the art would recognize.

Figure 20:
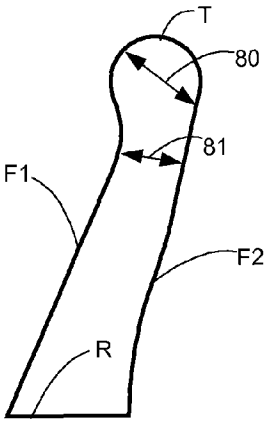
FIGS. 19-22 are example embodiments of rib profiles for endless and transverse ribs for the overmolded shutter of the present invention.
Figure 19:
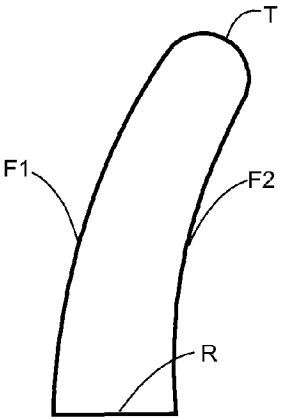
Figure 22:
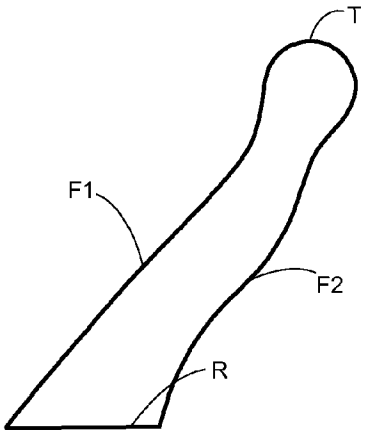
Figure 21:
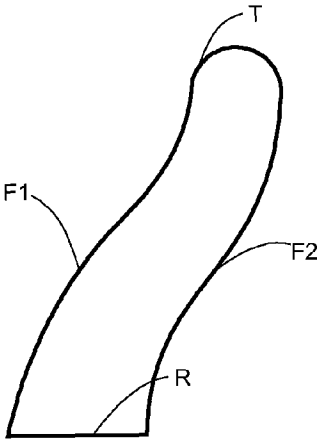

Referring to FIGS. 19-22, various example rib profiles are illustrated. These profiles may be used with the endless and transverse ribs previously discussed. Further the fibs rib profiles used in molding each of the endless and transverse ribs may be the same or each may be different. FIG. 19 illustrates a rib profile wherein the opposite faces F1, F2 are slightly curved or C-shaped and the faces taper inwardly from the root R at the sleeve to the tip T, with tip T being rounded. FIG. 20 illustrates a rib profile wherein face F1 tapers inwardly from root R in a generally linear fashion while face F2 tapers inwardly in a slightly curved manner from root R with tip T being rounded and more bulbous and having a diameter 80 that is greater than the thickness 81 of the rib immediately adjacent the tip T. FIG. 21 illustrates a rib profile wherein the opposite faces F1, F2 are slightly curved in an S-shape and the faces taper inwardly from the root R at the sleeve to the tip T, with tip T being rounded. FIG. 22 illustrates a rib profile wherein face F1 tapers inwardly from root R in a generally linear fashion while face F2 tapers inwardly in an S-shaped fashion from root R with tip T being rounded and more bulbous similar to the tip shown in FIG. 20. By using different rib profiles the magnitude of the seal force at the sealing interface and the shape and extent of the sealing interface between the rib tip and the wall of the housing in which the shutter body is inserted may be controlled.

Because the endless and transverse ribs are made using an overmolding process as is known to those of skill in the art, the features of the ribs as well as those of the sleeve in the overmolded seal may be more precisely controlled and positioned than is possible with the prior art foam seals. The acute angle to which the endless and transverse ribs are molded onto the sleeve may be between 10 to less than 90 degrees including all values and increments therein so that the ribs may deflect as described rather than being compressed between the shutter and the surrounding housing which occurs with foam and o-ring seals of the prior art.

Material suitable for forming the overmolded sleeve and ribs include thermoplastic elastomers (TPE), thermoplastic urethanes, thermoplastic vulcanizates such as SANTOPRENE®, or castable, injection molded or compression molded silicon rubber.

While the foregoing example embodiments of the overmolded shutter have been described as having entry or exit ports, such nomenclature is used only for descriptive purposes and is not intended to be limiting. Further, while the example overmolded shutters are described as having an open end, it should be realized that other configurations of channels for the passage of toner through the shutter body may also be used.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A shutter for mounting in a housing of a supply item for an imaging apparatus, the shutter, when installed, being rotatable between a first position and a second position for closing and opening a port within the housing through which toner can flow, the shutter comprising:

a body including a cylindrical hollow portion, the hollow portion sized to be received within a corresponding opening in the housing, the hollow portion having a first opening and a second opening forming a channel therebetween for carrying toner, wherein, when the shutter is in the first position, one of the first and second openings are closed by the housing and, when the shutter in the second position, one of the first and the second openings is in fluid communication with the port allowing toner to pass into the port; and a seal overmolded onto an exterior of the body, the seal comprising:

a sleeve molded around the exterior of the body having an opening therethrough aligned with the one of the first and second openings that is in fluid communication with the port; and a pair of endless ribs molded on the surface of the sleeve, the pair of endless ribs extending outwardly from the sleeve at an acute angle and axially positioned about the one of the first and second openings that is in fluid communication with the port, wherein, when the shutter is installed in the corresponding opening in the housing, the pair of endless ribs deflect forming a sealing interface with a surface of the corresponding opening, wherein one of the pair of endless ribs is positioned upstream of the one of the first and second openings that is in fluid communication with the port relative to a direction of toner flow and the other one of the pair of endless ribs is positioned downstream of the one of the first and second openings that is in fluid communication with the port relative to the direction of toner flow, further comprising a pair of spaced transverse ribs molded on the surface of the sleeve, the pair of transverse ribs extending outwardly from the sleeve at an acute angle and having the ends thereof joined to the pair of the endless ribs and surrounding the one of the first and second openings that is in fluid communication with the port, the transverse ribs deflecting and forming a further sealing interface with the housing.

2. The shutter of claim 1, wherein one endless rib of the pair of endless ribs is at an acute angle that is different than the acute angle of the other endless rib.

3. The shutter of claim 1, wherein one endless rib of the pair of endless ribs has a rib height that is different than a rib height of the other endless rib.

4. The shutter of claim 1, wherein a first plurality of gusset ribs is provided between a face of one endless rib of the pair of endless ribs and the sleeve and a second plurality of gusset ribs is provided between a face of the other endless rib of the pair of endless ribs and the sleeve.

5. The shutter of claim 4, wherein a third plurality of gusset ribs is provided between a face of one transverse rib of the pair of transverse ribs and the sleeve and a fourth plurality of gusset ribs is provided between a face of the other transverse rib of the pair of transverse ribs.

6. The shutter of claim 1, wherein the seal is formed from a material selected from a group consisting of thermoplastic elastomers (TPE), thermoplastic urethanes, thermoplastic vulcanizates, compression molded rubber, and silicon rubber.

7. The shutter of claim 1, wherein each endless rib has a rib profile selected from the group consisting of a C-shaped profile, an S-shaped profile, and a profile having a first face of the endless rib extending from the sleeve in a linear fashion with a second face of the endless rib extending from the sleeve in a curved fashion with the first and second faces tapering inwardly and forming a bulbous tip.

8. The shutter of claim 1, wherein the body further includes a grid pattern on a portion of the outer surface on which the sleeve is molded.

9. A shutter rotatably mountable in a housing of an imaging apparatus, the shutter rotatable between a first position and a second position for closing and opening a port within the housing through which toner can flow, the shutter comprising:

a body including a cylindrical hollow portion, the hollow portion sized to be received within a corresponding opening in the housing, a wall of the hollow portion having a first opening and a second opening connected by a channel therethrough for allowing the toner to flow between the first and second openings and the port when the shutter is in the second position with the second opening being immediately adjacent to the port, a portion of an outer surface of the hollow portion having scoring thereon; and a seal formed of an elastomeric material overmolded onto the portion of the outer surface having the scoring, the seal comprising:

a sleeve having an opening therethrough aligned with second opening in the wall of the hollow portion;

a pair of endless ribs molded on the surface of the sleeve, the pair of endless ribs extending outwardly from the sleeve and axially positioned about the second opening, one of the pair of endless ribs being positioned upstream of the one of the first and second openings that is in fluid communication with the port relative to a direction of toner flow and the other one of the pair of endless ribs is positioned downstream of the one of the first and second openings relative to the direction of toner flow; and a pair of spaced transverse ribs molded on the surface of the sleeve, the pair of transverse ribs extending outwardly from the sleeve at an acute angle and having the ends thereof joined to the pair of the endless ribs and surrounding the second opening, the pair of transverse ribs and the pair of endless ribs having a height that is greater than a clearance between the hollow portion of the body and the corresponding opening in the housing, wherein, when the shutter is installed in the housing, the pair of endless ribs and pair of transverse ribs deflect forming a sealing interface at their respective tips with the housing.

10. The shutter of claim 9, wherein one endless rib of the pair of endless ribs is at an acute angle that is different than the acute angle of the other endless rib.

11. The shutter of claim 9, wherein one endless rib of the pair of endless ribs has a rib height that is different than a rib height of the other endless rib.

12. The shutter of claim 9, wherein a first plurality of gusset ribs is provided between a face of one endless rib of the pair of endless ribs and the sleeve, a second plurality of gusset ribs is provided between a face of the other endless rib of the pair of endless ribs and the sleeve, a third plurality of gusset ribs is provided between a face of one transverse rib of the pair of transverse ribs and the sleeve and a fourth plurality of gusset ribs is provided between a face of the other transverse rib of the pair of transverse ribs.

13. The shutter of claim 9, wherein the seal is formed from a material selected from a group consisting of thermoplastic elastomers (TPE), thermoplastic urethanes, thermoplastic vulcanizates, compression molded rubber, and silicon rubber.

14. The shutter of claim 9, wherein each endless rib and each transverse rib has a rib profile selected from the group consisting of a C-shaped profile, an S-shaped profile, and a profile having a first face of the endless rib extending from the sleeve in a linear fashion with a second face of the endless rib extending from the sleeve in a curved fashion with the first and second faces tapering inwardly and forming a bulbous tip.

15. A rotatable shutter for an imaging apparatus, comprising:

a body having a circular cross section and a toner passageway, the toner passageway including an exit opening through an outer circumferential portion of the body and an entrance opening, the body having an axis of rotation; and an elastomeric seal overmolded onto an outer surface of the body, the seal including:

a sleeve molded around the outer surface of the body having an opening therethrough aligned with the exit opening of the toner passageway;

a pair of deflectable endless ribs molded on the surface of the sleeve, each of the pair of endless ribs extending outward from the sleeve and extending around the circumference of the body, the pair of endless ribs positioned on opposite axial sides of the exit opening; and a pair of deflectable transverse ribs molded on the surface of the sleeve, each of the pair of transverse ribs extending outward from the sleeve and extending from a first of the pair of endless ribs to a second of the pair of endless ribs, the pair of transverse ribs positioned on opposite circumferential sides of the exit opening.

16. The shutter of claim 15, wherein each of the pair of endless ribs extends outward at an acute angle from the sleeve angled away from the exit opening.

17. The shutter of claim 16, wherein each of the pair of transverse ribs extends outward at an acute angle from the sleeve angled away from the exit opening.

18. The shutter of claim 15, wherein the seal includes a plurality of gusset ribs spaced about each of the pair of endless ribs, each gusset rib molded between a face of the endless rib and the sleeve.

* * * * *